United States Patent [19]

Larinoff

[11] 4,240,502

[45] Dec. 23, 1980

[54] CONDENSING HEAT EXCHANGER

[75] Inventor: Michael W. Larinoff, Houston, Tex.

[73] Assignee: Hudson Products Corporation, Houston, Tex.

[21] Appl. No.: 94,117

[22] Filed: Nov. 26, 1979

[51] Int. Cl.[3] ..... F28B 9/08; F28B 9/10

[52] U.S. Cl. ..... 165/112; 165/113; 165/114; 165/DIG. 1

[58] Field of Search ..... 65/110, 111, 112, 113, 65/114, DIG. 1

[56] References Cited

U.S. PATENT DOCUMENTS

| | | | |
|---|---|---|---|
| 667,522 | 2/1901 | Hiller | 165/111 |
| 686,432 | 11/1901 | Wolf | 165/111 |
| 3,675,710 | 7/1972 | Riston | 165/111 |
| 3,705,621 | 12/1972 | Schoonman | 165/111 |
| 3,789,919 | 2/1974 | Huber | 165/110 |
| 3,968,836 | 7/1976 | Larinoff | 165/111 |
| 4,129,180 | 12/1978 | Larinoff | 165/111 |

FOREIGN PATENT DOCUMENTS

| | | | |
|---|---|---|---|
| 1185248 | 3/1970 | United Kingdom | 165/DIG. 1 |

*Primary Examiner*—Sheldon Richter
*Attorney, Agent, or Firm*—Marvin B. Eickenroht; Jennings B. Thompson

[57] ABSTRACT

There is disclosed a heat exchanger having one or more bundles of tubes through which steam or other vapor is passed and comprising horizontally arranged rows of tubes each of which is connected to a separate outlet header. Condensate from the outlet headers of each bundle is drained into a pot having individual water leg seals which isolate vapor pressure within such outlet headers from one another. The outlet headers are of generally rectangular cross section and staggered in a horizontal direction, with the lower end of each successive outlet header to be contacted by air extending below the upper end of the preceding outlet header. The tubes of each such successive row of tubes are longer than those of the preceding row to be contacted by air and extend over the upper end of the outlet header connecting with the tubes of the preceding row of tubes.

2 Claims, 6 Drawing Figures

CONDENSING HEAT EXCHANGER

This invention relates to heat exchangers of the general type having one or more bundles of tubes through which steam or other vapor is to be passed and arranged so that air is caused to flow past successive rows thereof. More particularly, it relates to improvements in heat exchangers of this type wherein each row of tubes of each bundle is connected to a separate outlet or condensate header, and the several headers are in turn connected to a condensate drain pot by means of individual water leg seals which isolate pressure within the outlet headers from one another.

Heat exchangers of this type are commonly used for condensing steam from the turbine exhaust of a power plant, although they may be used in condensing other vapors, and, for that matter, may be used to heat the air which is caused to pass over the tubes. In this latter case, the heat exchanger is not used as an atmospheric waste heat discharge device, but rather as a utility steam heater of large volumes of air or gas.

In any case, however, since the air is warmed as it is caused to pass over the successive rows of tubes, it is coldest as it passes the first row and warmest as it passes the last row. As a result, steam in the successive rows is condensed at different rates, with the most steam being condensed in the first row, resulting in the largest pressure drop thereacross, and the least being condensed in the last row, resulting in the smallest pressure drop thereacross.

If the tubes of all rows were directly connected to a common condensate header, the difference in steam pressure drops across each row would cause steam to pass through the condensate header from the tubes of the last rows to be contacted by air to those of the first rows to be so contacted. Steam would thus be entering both ends of the tubes of the first rows, thereby trapping pockets of non-condensibles in them. This would cause the tube walls in the area of the pockets to become cool, thereby causing the flowing condensate in the tubes to freeze during cold ambient temperature conditions.

To protect against such condensate freezing, it has been proposed to connect each row of tubes of each bundle of such a heat exchanger with an individual outlet header, and connect outlets from the several headers to a common condensate collecting vessel by means of water leg seals which isolate the condensate headers of the various rows of each bundle from one another since they each have different steam pressures. This insures unidirectional steam flow in the tubes of all rows, thereby preventing the formation of trapped pockets of non-condensibles in the tubes of certain rows so as to prevent the condensate in the tubes from freezing.

U.S. Pat. No. 3,968,936 discloses and claims improvements in heat exchangers of this general type in which water leg seal tubes connecting with the outlets from the lower ends of the condensate headers of each bundle extend into a common drain pot, and an additional tube connects one outlet header above its lower end with the drain pot above the condensate level therein so as to introduce uncondensed vapor from such outlet header into the condensate drain pot. In addition to providing a simplified and compact arrangement, as compared with similar heat exchangers having individual water leg seals of conventional, exposed, construction, this improved heat exchanger bundle prevents freeze-up of the water leg seals themselves by enclosing them within the drain pot and warming them with steam from the header to which the additional tube connects.

It's necessary to maintain a minimum level of condensate within each condensate header in order to insure complete drainage through the outlet therefrom into the drain pot, while at the same time maintaining the liquid level below that of the lower ends of the tubes of the row connecting with the header. When the tube bundles of such a heat exchanger are inclined, as in the "A" frame arrangement shown in U.S. Pat. No. 4,129,180, this will normally not present a problem since the outlet headers, being in generally side-by-side relation, may be of most any height necessary to provide the required hydraulic head of condensate to insure complete flow.

This is not true, however, when the tube bundles are arranged horizontally, because, as well known in the art, the spacing between tubes in adjacent rows is relatively fixed. Consequently, in conventional heat exchangers of this latter type, wherein the bundle outlet headers are arranged one above the other, the available hydraulic head of condensate may not be sufficient to cause condensate to flow through the outlet into the drain pot at the required draining flow rate.

The primary object of this invention is to provide a heat exchanger of this latter type wherein the bundle outlet headers connected to the rows of horizontal tubes are so arranged and constructed as to substantially increase the hydraulic condensate head therein.

Another object is to provide such a heat exchanger wherein the tube bundle itself requires no more headroom than bundles having outlet headers arranged in conventional fashion.

Still another object is to provide such a heat exchanger bundle in which the outlet headers are of relatively simple, inexpensive construction.

These and other objects are accomplished, in accordance with the illustrated embodiment of the invention, by a heat exchanger bundle of the type described wherein the outlet header connecting with the tubes of each successive row of horizontally arranged tubes has a lower end which extends below the upper end of the outlet header connecting with the tubes of the preceding row. Consequently, the condensate hydraulic head in each outlet header is not limited by the vertical spacing between the tubes of successive rows, and the header may, if necessary, extend vertically for a distance two or more times that of such spacing. Preferably, each outlet header is of generally rectangular shape in cross section having side walls which extend generally in the direction of air flow, and the tubes of each successive row to be contacted by the air are longer than those of the preceding row so contacted by the air. Being of generally rectangular shape, each header may be easily and inexpensively fabricated—e.g., from a metal sheet bent at its four corners and welded together along its edges.

In the drawings, wherein like reference characters are used throughout to designate like parts:

Figures 1, 2:
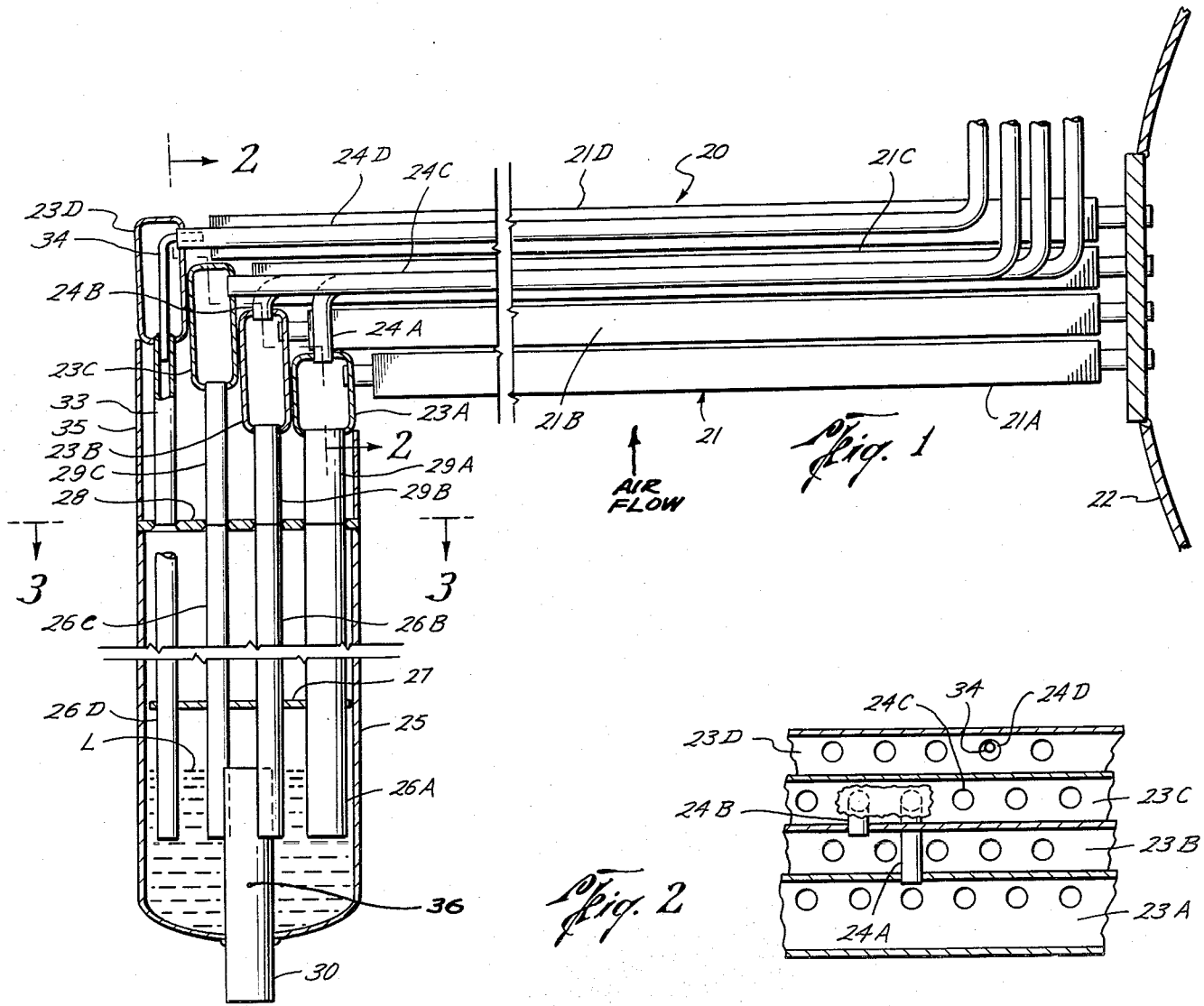
FIG. 1 is a longitudinal sectional view of a heat exchanger constructed in accordance with the present invention.
FIG. 2 is a vertical cross-sectional view of the outlet headers of the heat exchanger, as seen along broken lines 2—2 of FIG. 1.

With reference now to the details of the above-described drawings, the heat exchanger, which is designated in its entirety by reference character 20, includes a tube bundle 21 made up of four substantially horizontally disposed, closely spaced-apart rows 21A, 21B, 21C and 21D of finned tubes. The righthand ends of the tube rows are connected to an inlet header 22, and the outlet ends of the tubes of each row 21A–21D are connected to individual outlet headers 23A, 23B, 23C and 23D, respectively. As indicated by the arrow of FIG. 1, in this illustrated embodiment of this invention, air is caused to flow upwardly across the tube bundle and thus successively over the rows 21A–21D of tubes.

Steam or other condensible vapor is introduced into the inlet header 22 for passage through the tubes of the tube bundle into the outlet headers 23A to 23D. When this heat exchanger is used as a steam condenser, as is contemplated by its illustrated embodiment, all of the steam passing through the tube bundle is condensed by the flow of cooling air therepast with the exception of a small amount that is withdrawn with the non-condensible vapors. The condensate as well as some small amount of uncondensed vapors remain in the outlet headers 23A–23D.

As illustrated, in FIGS. 1 and 2, heat exchanger 20 is similar to the heat exchanger of U.S. Pat. No. 4,129,180 in that it includes a main portion in which the steam is condensed, as well as a vent portion through which a small amount of uncondensed steam and non-condensibles in each of the outlet headers 23A to 23D is passed for further cooling with air. For this purpose, and as more fully described in U.S. Pat. No. 4,129,180, one or more vent tubes connects with an upper portion of each outlet header for extension substantially horizontally within the tube bundle 21 in one or more of the tube rows 21A to 21D. Thus, as shown in FIG. 1, a vent tube 24A connects with the upper end of outlet header 23A, a vent tube 24B connects with the upper end of outlet header 23B, a vent tube 24C connects with an upper portion of outlet header 23C, and a vent tube 24D connects with an upper portion of outlet header 23D.

As also shown in FIGS. 1 and 2, and as is true of the embodiments of the heat exchanger shown in U.S. Pat. No. 4,129,180, the vent tubes connecting with the first and second tube rows 21A and 21B to be contacted by air flow preferably extend within the third row 21C to be so contacted. Thus, as shown in FIGS. 1 and 2, each of the vent tubes 24A and 24B includes a downturned inlet end which extends through the upper end of the outlet header with which it is connected. The outlet ends of the vent tubes, which extend to positions near the inlet header 22, are bent upwardly for connection to air removal equipment (not shown) of the type shown and described in the aforementioned U.S. Pat. No. 4,129,180.

Figure 4:
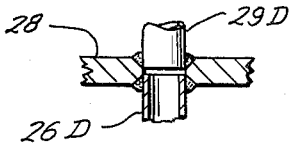
FIG. 4 is an enlarged, detailed sectional view of the connection of the outlet from one of the headers to a leg seal tube within the drain pot of the heat exchanger.

Heat exchanger 20 also includes a vertically-disposed drain pot 25 suspended in any suitable fashion beneath the outlet headers 23A to 23D in position to receive the condensate therefrom. Water leg seals 26A to 26D extend vertically within the drain pot and are held in predetermined spaced relation therein by means of a plate 27. The upper ends of the water leg seal tubes 26A to 26D connect with holes in a cover plate 28 closing the upper end of the drain pot, and thus connect with the individual outlet headers of the bundle by means of further tubes 29A to 29D, respectively, connecting at their lower ends with the holes in the cover plate 28 and their upper ends with the lower ends of individual outlet headers 23A to 23D, respectively. Thus, condensate within outlet header 23A flows downwardly into the drain pot through tubes 29A and 26A, and condensate within outlet headers 23B, 23C and 23D flows downwardly into the pot through tubes 29B and 26B, 29C and 26C, and 29D and 26D. The lower ends of the tubes 29A to 29D and the upper ends of the leg tube seals 26A to 26D are connected to the holes in cover 28 by suitable welds, as shown in FIG. 4.

The lower ends of the leg seal tubes 26A to 26D extend below a liquid level L which is maintained within the drain pot at a height determined by the upper end of an outlet pipe 30 extending through the lower end of the drain pot. In the illustrated embodiment of the invention, vapors from within outlet header 23D connecting with the row 21D of tubes last to be contacted by air are admitted to the drain pot above the liquid level. This vapor pressure is, of course, higher than that within the other outlet headers inasmuch as there has been less pressure drop in the tubes of the last row to be contacted by air than in the tubes of the other rows. Although the level of condensate within the water leg seals is not shown in the drawings, it will be understood from the foregoing description that it will be at substantially the level L of condensate within the drain pipe 25 in the water leg seal 26D, and will be at progressively higher levels within the water leg seal tubes 26C, 26B and 26A, respectively.

Figure 5:
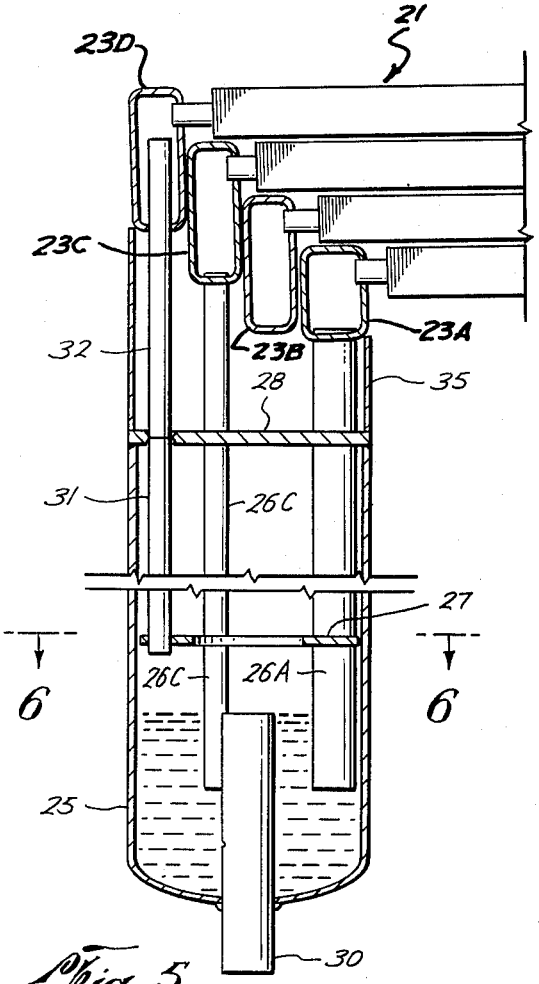
FIG. 5 is a longitudinal sectional view of the heat exchanger, as seen along broken lines 5—5 of FIG. 6.
Figure 3:
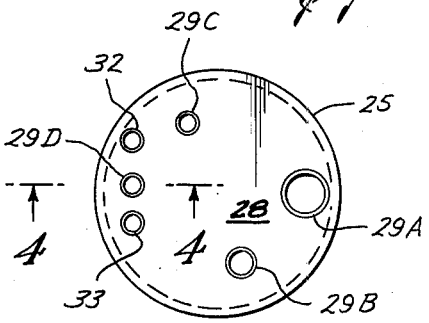
FIG. 3 is a horizontal cross-sectional view of the heat exchanger, as seen along broken lines 3—3 of FIG. 1.
Figure 6:
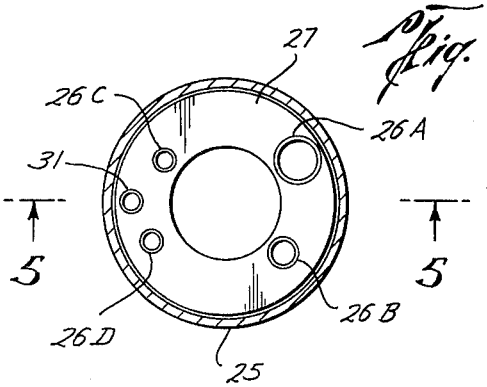
FIG. 6 is a horizontal cross-sectional view of the drain pot, as seen along broken lines 6—6 of FIG. 5.

As shown in FIG. 5, vapor within the outlet header 23B is admitted to the drain pot above the liquid level L through a tube 31 connecting at its upper end with another hole in the cover 28 and having a lower end above the liquid level, as shown in FIG. 5. Tube 31, like the leg seal tubes, is held in proper position by extension through aligning plate 27. Tube 31 is connected with outlet header 23D above the condensate level therein by means of a tube 32 whose lower end connects with the aforementioned hole in the cover plate 28 and whose upper end extends through the lower end of outlet header 23B to the level shown in FIG. 5. It will be appreciated, however, that, if desired, vapor pressure within one of the other outlet headers may instead be communicated to the drain pot above the liquid level therein. This of course would change the relative heights of the four water legs and might require some minor changes in pipe lengths and drain pipe level L.

Non-condensibles within the drain pot are vented to the aforementioned air removal equipment by means of a tube 33 (see FIG. 1) whose lower end connects with still another hole in the cover plate 28 and whose upper end extends upwardly into outlet header 23D, and a smaller conduit 34 whose lower end is sealed within the upper end of tube 33 and whose upper, laterally bent end is inserted into the inlet end of vent tube 24D. As best shown, in FIG. 2, the relatively small diameter of tube 34 provides space between it and the inner diameter of vent tube 24D, and the confined flow of non-condensibles and uncondensed vapors from outlet header 23D through this space aids in drawing non-condensibles upwardly from the drain pot into vent tube 24D.

Since the air flowing past the tube bundle is coolest as it passes over the lower row 21A of tubes, so that more steam is condensed in the lower row than is condensed in subsequent tube rows to be contacted by air, bundle outlet header 23A is larger than outlet headers 23B to 23D. In like manner, water leg seal tube 26A and connecting tube 29A are larger than water leg seal tubes 26B to 26D and connecting tubes 29B to 29D. The total amount of steam condensed in each of the rows 21B and 21D is more equal, so that the outlet headers 23B and 23D and the tubes to which they connect, may be of substantially the same size for commercial reasons.

Connecting tubes 29A to 29D are surrounded by a metal heat shield 35 which is mounted on the cover 28 and extends upwardly to the lower ends of the outlet headers. In cold environments, heat insulation will be inserted within the shield void to surround the connecting tubes and prevent freeze-up of condensate therein as it flows from the outlet headers into the drain pot. In this latter regard, and as explained in U.S. Pat. No. 3,968,836, the piping of condensible warm vapors from within outlet headers 23D, or one of the other outlet headers, into the drain pot 25 through tubes 31 and 32 also serves to heat the water leg seal tubes within the pot, and thus assist in preventing their freeze-up in the drain pot in similar environments. As also explained in such earlier patent, a small drain hole 36 is in drain pipe 30 which allows the condensate to automatically drain from the pot when the steam condensing system is shut down.

As previously described, in order to obtain a sufficient head of condensate to insure proper flow of condensate through the outlets therefrom into the drain pot, each of the headers 26B to 26D is elongated in a vertical direction to extend its lower end below the upper end of the outlet header connecting with the tubes of the preceding tube row. That is, the lower end of outlet header 23B extends below the upper end of outlet header 23A, the lower end of outlet header 23C extends below the upper end of outlet header 23B and the lower end of outlet header 23D extends below the upper end of outlet header 23C. In the particular illustrated embodiment of the invention, the lower end of outlet header 23B extends to substantially the same level as the lower end of outlet header 23A. It will also be appreciated that the lower ends of the outlet headers 23C and 23D may extend below that shown, and in fact may extend downwardly as far as the lower end of preceding outlet header 23B without increasing the height dimension of the outlet header section of the overall heat exchanger. It will further be appreciated from the foregoing description that this horizontal staggering of the lower ends of the outlet headers simplifies their connection to the upper ends of the leg seal tubes in the drain pot in that each of the connecting tubes 29A to 29D need comprise only a straight section of tubing, as shown.

As also previously described, each of the outlet headers of each bundle is of rectangular cross section with its inner vertical side wall, to which the tubes of one row of the tube bundle are connected, extending close to the outermost vertical side wall of the preceding outlet header. As previously described, this enables each of the headers 23B to 23D, as well as the header 23A, to be made in a simple and inexpensive manner, such as by rolling and welding a flat metal sheet. With this preferred construction of the outlet headers, the tubes of the tube rows are of different lengths, with the lefthand ends of the tubes of each row extending above the upper end of the preceding outlet header for connection with the successive outlet header. That is, the tubes in row 21B extend above the upper end of outlet header 23A for connection with the upper portion of outlet header 23B, the tubes of row 21C extend above the upper end of outlet header 23B for connection with an upper portion of outlet header 23C, and the tubes of row 21D extend above the upper end of outlet header 23C for connection with an upper portion of outlet header 23D.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A heat exchanger, comprising a tube bundle having a plurality of parallel rows of tubes adapted to be disposed in generally horizontal positions and arranged successively in the direction of air flow therepast, an inlet header for introducing vapor into one end of the tubes of the rows, a plurality of outlet headers each connecting with the opposite ends of the tubes of one row for receiving condensate and uncondensed vapor therefrom, the outlet header connecting with the tubes of each successive row having a lower end which extends below the upper end of the outlet header connecting with the tubes of the preceding row, each outlet header having an outlet from the lower end thereof, a generally upright condensate drain pot disposed beneath the outlet headers and having a plurality of water leg seal tubes therein, means connecting the outlet from each outlet header with one water leg seal tube, means for maintaining the level of condensate within the drain pot above the lower ends of the leg seal tubes so as to isolate pressure within said outlet headers from one another, means connecting one outlet header above the lower end thereof with the drain pot above the condensate level therein so as to introduce uncondensed vapor from said one outlet header into said drain pot, and means for automatically draining condensate from the pot when the vapor condensing system is shut down.

2. A heat exchanger, comprising a tube bundle having a plurality of parallel rows of tubes adapted to be disposed in generally horizontal positions and arranged successively in the direction of air flow therepast, an inlet header for introducing vapor into one end of the tubes of the rows, a plurality of outlet headers each connecting with the opposite ends of the tubes of one row for receiving condensate and uncondensed vapor therefrom, each outlet header being of generally rectangular shape in cross section having vertical side walls and a lower end which extends below the upper end of the outlet header connecting with the tubes of the preceding row, the tubes of each successive row of tubes being longer than those of the preceding row and extending over the upper end of the outlet header connecting with the tubes of the preceding row, each outlet header having an outlet from the lower end thereof, a generally upright drain pot disposed beneath the outlet headers and having a plurality of leg seal tubes therein, means connecting the outlet from each outlet header with one leg seal tube, means for maintaining the level of condensate within the drain pot above the lower ends of the leg seal tubes so as to isolate pressure within said outlet headers from one another, and means connecting one outlet header above the lower end thereof with the drain pot above the condensate level therein so as to introduce uncondensed vapor from said outlet header into said drain pot.

* * * * *